US006864465B2

(12) United States Patent
Berkcan et al.

(10) Patent No.: US 6,864,465 B2
(45) Date of Patent: Mar. 8, 2005

(54) ERROR CORRECTION FOR OPTICAL DETECTOR IN GLASS-CERAMIC COOKTOP APPLIANCES

(75) Inventors: Ertugrul Berkcan, Clifton Park, NY (US); Emilie Thorbjorg Saulnier, East Greenbush, NY (US)

(73) Assignee: General Electric Company, Niskayuna, NY (US)

( * ) Notice: Subject to any disclaimer, the term of this patent is extended or adjusted under 35 U.S.C. 154(b) by 29 days.

(21) Appl. No.: 10/305,883

(22) Filed: Nov. 27, 2002

(65) Prior Publication Data

US 2004/0099652 A1 May 27, 2004

(51) Int. Cl.[7] ..... H05B 3/68; H05B 1/02
(52) U.S. Cl. ..... 219/448.11; 219/502
(58) Field of Search ..... 219/443.1, 444.1, 219/446.1, 447.1, 448.11, 448.12, 460.1, 461.1, 462.1, 465.1, 468.2, 482, 497, 502; 374/120, 121, 130, 131, 132, 133; 356/43, 45

(56) References Cited

U.S. PATENT DOCUMENTS 5,155,338 A * 10/1992 Hoffmann ..... 219/445.1
6,118,105 A * 9/2000 Berkcan et al. ..... 219/497
6,225,607 B1 * 5/2001 Has et al. ..... 219/448.11
6,403,930 B2 * 6/2002 Deo et al. ..... 219/460.1

* cited by examiner

*Primary Examiner*—Sang Paik
(74) *Attorney, Agent, or Firm*—Fletcher Yoder

(57) ABSTRACT

A sensor assembly for a glass-ceramic cooktop appliance having at least one burner assembly disposed under a glass-ceramic plate. The sensor assembly includes an optical detector arranged to receive radiation from the glass-ceramic plate and produce an output signal corresponding to a cooktop related property of the glass-ceramic plate. A controller is provided to receive the output signal from the optical detector. The controller includes means for making a correction to said output signal for corruptive flux incident on the optical detector.

37 Claims, 3 Drawing Sheets

ERROR CORRECTION FOR OPTICAL DETECTOR IN GLASS-CERAMIC COOKTOP APPLIANCES

BACKGROUND OF THE INVENTION

This invention relates generally to glass-ceramic cooktop appliances and more particularly to improving temperature measurement therein.

The use of glass-ceramic plates as cooktops in cooking appliances is well known. Such glass-ceramic cooktops have a smooth surface that presents a pleasing appearance and is easily cleaned in that the smooth, continuous surface prevents spillovers from falling onto the heating unit underneath the cooktop.

In one known type of glass-ceramic cooktop appliance, the glass-ceramic plate is heated by radiation from a heating unit, such as an electric coil or a gas burner, disposed beneath the plate. The glass-ceramic plate is sufficiently heated by the heating unit to heat utensils upon it primarily by conduction from the heated glass-ceramic plate to the utensil. Another type of glass-ceramic cooktop appliance uses a heating unit that radiates substantially in the infrared region in combination with a glass-ceramic plate that is substantially transparent to such radiation. In these appliances, a utensil placed on the cooktop is heated primarily by radiation transmitted directly from the heating unit to the utensil, rather than by conduction from the glass-ceramic plate. Such radiant glass-ceramic cooktops are more thermally efficient than other glass-ceramic cooktops and have the further advantage of responding more quickly to changes in the power level applied to the heating unit.

In both types of glass-ceramic cooktop appliances, provision must be made to avoid overheating the cooktop. For most glass-ceramic materials, the operating temperature should not exceed 700° C. for any prolonged period. Under normal operating conditions, the temperature of the glass-ceramic plate will generally remain below this limit. However, conditions can occur which can cause this temperature limit to be exceeded. Commonly occurring examples include operating the appliance with no load, i.e., no utensil, on the cooktop surface, using badly warped utensils that make uneven contact with the cooktop surface, and operating the appliance with a shiny and/or empty utensil.

To protect the glass-ceramic from extreme temperatures, glass-ceramic cooktop appliances ordinarily have some sort of temperature sensing device that can cause the heating unit to be shut down if high temperatures are detected. In addition to providing thermal protection, such temperature sensors can be used to provide temperature-based control of the cooking surface and to provide a hot surface indication, such as a warning light, after a burner has been turned off.

One common approach to sensing temperature in glass-ceramic cooktop appliances is to place a temperature sensor directly on the underside of the glass-ceramic plate. With this approach, however, the temperature sensor is subject to the high burner temperatures and thus more susceptible to failure. Moreover, direct contact sensors detect some average flux and do not produce a direct measurement of the glass-ceramic temperature. Thus, it is desirable to use an optical sensor assembly that "looks" at the glass-ceramic surface from a remote location to detect the temperature of the surface.

A remote sensor assembly determines the glass-ceramic temperature based on the amount of radiated flux it receives from the glass-ceramic plate or a utensil. However, in addition to flux radiated from the glass-ceramic plate, the sensor will receive flux that is reflected from the bottom of the glass-ceramic plate. This is because during operation of the cooktop appliance, the heating unit emits energy that strikes the underside of the glass-ceramic plate. Some of this energy will be absorbed by the glass-ceramic plate (thereby raising the plate temperature), and some of the energy will be transmitted through the glass-ceramic plate. The rest of the energy, which is not an insignificant amount, will be reflected by the glass-ceramic plate. The reflected flux that strikes the sensor assembly will affect the accuracy of the temperature measurement. Flux reflected from other sources, such as metal burner components or a utensil placed on the glass-ceramic plate, can also strike the sensor assembly. The sensor assembly can also receive flux from background radiation sources, such as ambient lighting, that is transmitted through the glass-ceramic plate.

Accordingly, there is a need for a remote sensor assembly that can reduce and/or compensate for corruptive flux.

BRIEF SUMMARY OF THE INVENTION

The above-mentioned needs are met by the present invention which provides a sensor assembly for a glass-ceramic cooktop appliance having at least one burner assembly disposed under a glass-ceramic plate. The sensor assembly includes an optical detector arranged to receive radiation from the glass-ceramic plate and produce an output signal corresponding to a cooktop related property of the glass-ceramic plate. A controller is provided to receive the output signal from the optical detector. The controller includes means for making a correction to said output signal for corruptive flux incident on the optical detector.

The present invention and its advantages over the prior art will be more readily understood upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
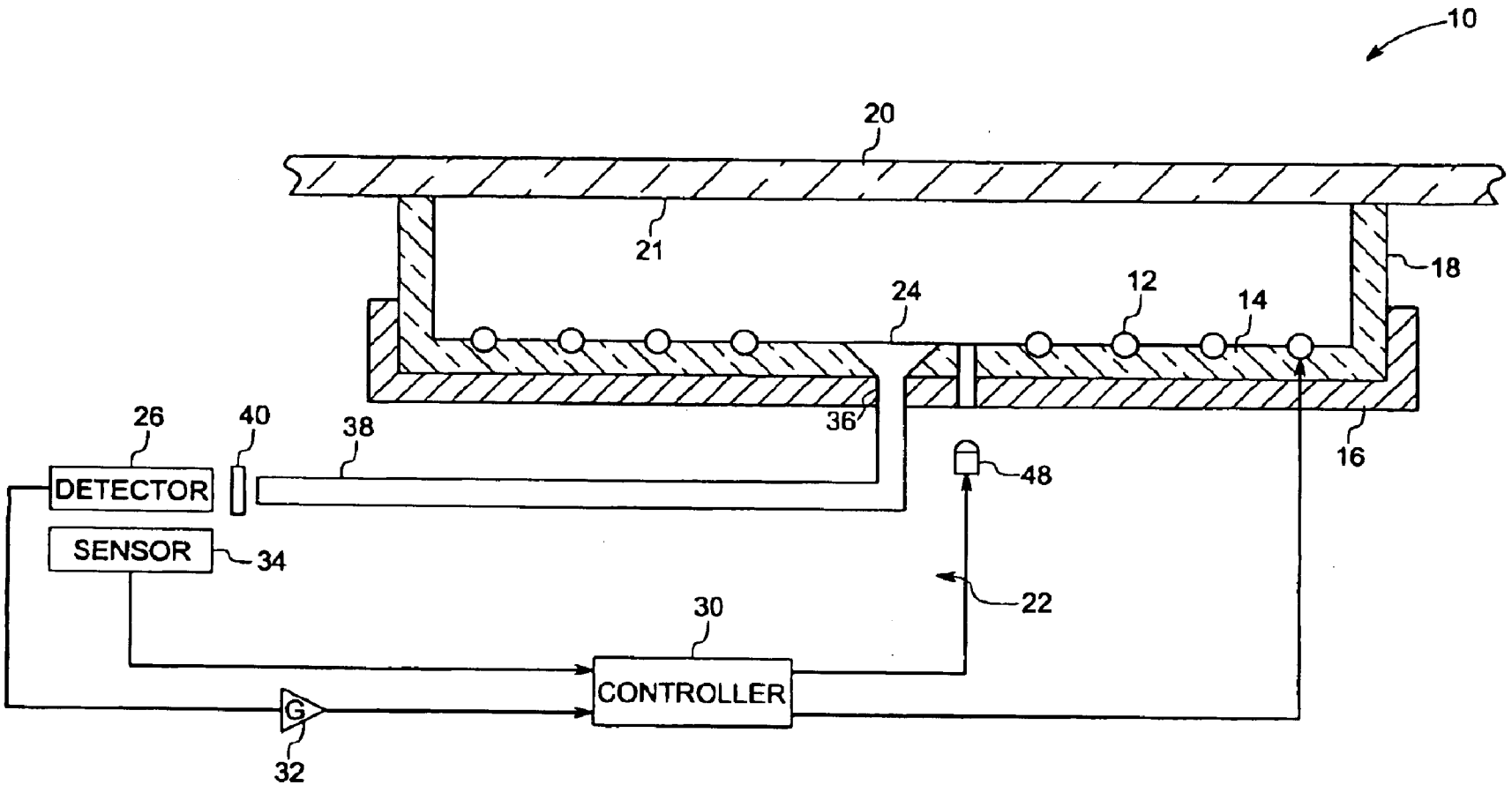
FIG. 1 is a partly schematic, sectional view of a burner assembly having an optical sensor assembly of the present invention.

Referring to the drawings wherein identical reference numerals denote the same elements throughout the various views, FIG. 1 shows a burner assembly 10 of the type suitable for use in a glass-ceramic cooktop appliance, which typically includes a plurality of such burner assemblies. As used herein, the term "cooktop" is intended to refer to both the flat top of a range or stove and a built-in cabinet-top cooking apparatus. Burner assembly 10 includes an open coil electrical resistance element 12, which is designed when fully energized to radiate primarily in the infrared region of the electromagnetic energy spectrum. It should be noted that another type of heating unit, such as a gas burner, could be used in place of element 12. Element 12 is arranged in an effective heating pattern such as a concentric coil and is secured to the base of an insulating liner 14 which is supported in a sheet metal support pan 16. Insulating liner 14 includes an annular, upwardly extending portion 18 which serves as an insulating spacer between element 12 and a glass-ceramic plate 20 that provides the cooktop surface. Support pan 16 is spring loaded upwardly, forcing annular portion 18 into abutting engagement with the underside 21 of glass-ceramic plate 20, by conventional support means (not shown).

An optical sensor assembly 22 is provided to detect one or more characteristics relating to the cooking appliance (referred to herein as "cooktop related properties"), such as the temperature of glass-ceramic plate 20, the presence or absence of a utensil on the cooktop, the temperature, size or type of utensil on the cooktop, and/or the properties or state of the utensil contents. Sensor assembly 22 includes a radiation collector 24 disposed in the interior of burner assembly 10 underneath glass-ceramic plate 20. This location provides radiation collector 24 with a field of view of the desired sensing location (i.e., the portion of glass-ceramic plate 20 directly over burner assembly 10). Radiation collector 24 thus collects flux that is radiated from glass-ceramic plate 20. Radiation collector 24 will also collect flux that is reflected from the underside 21 of glass-ceramic plate 20, flux that is reflected from non-glass structure, and ambient flux that is radiated through glass-ceramic plate 20.

The flux gathered by radiation collector 24 is delivered to an optical detector 26 located at a relatively cool place outside of burner assembly 10 via a light pipe or waveguide 28. Waveguide 28 allows detector 26 to be located where the thermal environment is more favorable. The use of waveguides also permits the co-location and sharing of detectors among several burner assemblies. The output from detector 26 is fed to a controller 30, which is a common element used in most glass-ceramic cooktop appliances, via a gain stage amplifier 32. In addition to other operations, controller 30 controls the power level of heating unit 12 in response to the user selected settings for burner assembly 10 as well as the glass-ceramic temperature input. A temperature sensor 34 is disposed adjacent to optical detector 26 to monitor the temperature of the detector casing. The output of temperature sensor 34 is also fed to controller 30.

Waveguide 28 is preferably a metal tube having a highly reflective internal surface. More preferably, waveguide 28 is provided with an internal coating that is an excellent infrared reflector and has very low emissivity. Gold is one preferred internal coating material because of its high reflectivity and low emissivity. To prevent the tube material, which is preferably a metal such as copper, from bleeding into the internal coating, a barrier layer can be deposited between the metal tube and the internal coating. The barrier layer can comprise any suitable material, such as nickel or nichrome.

Waveguide 28 extends through the bottom of insulating liner 14 and support pan 16 so as to have a first or entry end 36 disposed in the interior of burner assembly 10 adjacent to radiation collector 24 and a second or exit end 38 located outside of burner assembly 10 adjacent to detector 26. As will be described in more detail below, a filter 40 is disposed between optical detector 26 and exit end 38 of waveguide 28. Preferably, waveguide 28 extends through the bottom of insulating liner 14 and support pan 16 at their respective center points so as not to interfere with element 12.

As shown in FIG. 1, waveguide 28 is gently bent at a point intermediate its two ends so as to reflect radiation through a 90-degree turn. Thus, detector 26 is located not only below burner assembly 10 but also beyond its outer circumference. This configuration could alternatively be accomplished by providing waveguide 28 with a planar region formed at a 45-degree angle. Furthermore, it should be noted that waveguide 28 could also be straight, without any bend, so that detector 26 would be located directly below the point at which waveguide 28 extends through the bottom of insulating liner 14 and support pan 16.

Figure 2:
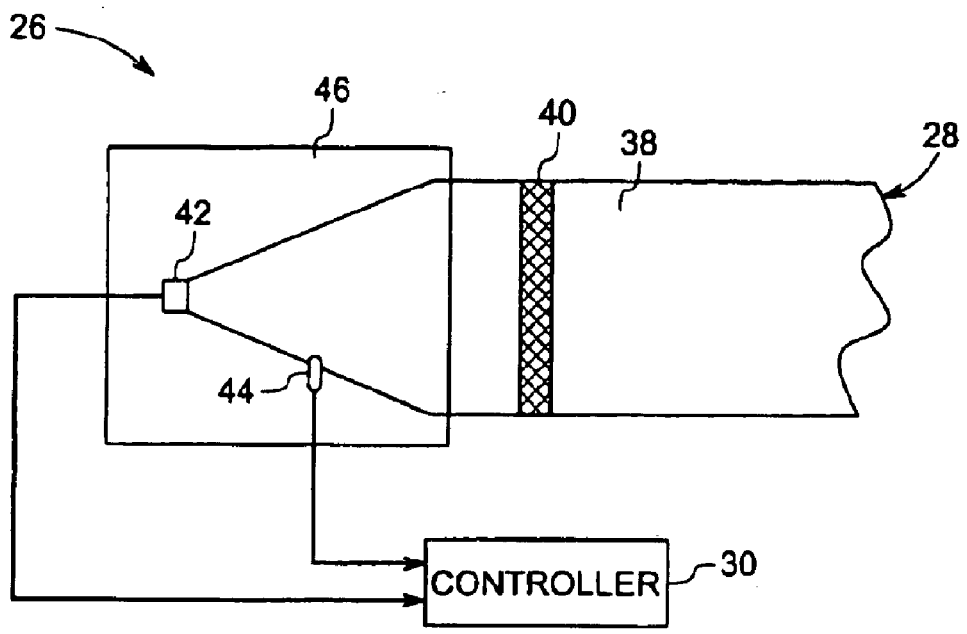
FIG. 2 is a schematic view of a portion of the sensor assembly of FIG. 1.

Turning to FIG. 2, optical detector 26 is shown in more detail. In this embodiment, detector 26 includes a first detector element 42 devoted to sensing the temperature of glass-ceramic plate 20 and a second detector element 44 devoted to sensing other cooktop related properties such as the presence or absence of a utensil on the cooktop. First detector element 42 can be any suitable type of temperature detector such as bolometer or thermopile; second detector 44 is preferably a quantum detector such as a silicon or germanium photodiode. As shown in FIG. 2, first detector element 42 is located at the tip of an exit concentrator 46 attached to exit end 38 of waveguide 28, and second detector element 44 is disposed on the periphery of exit concentrator 46, although other configurations are possible.

With this two-detector element configuration, sensor assembly 22 is able to monitor the glass-ceramic temperature with first detector element 42 and other cooktop related properties with second detector element 44. For instance, the presence or absence of a utensil on the cooktop surface is determined by "looking" through glass-ceramic plate 20 to detect the amount of flux that has been reflected from the bottom of the utensil. This is accomplished by taking advantage of the fact that at certain wavelengths a large portion (typically in the range of about 80%) of the flux emitted by heating unit 12 is transmitted through glass-ceramic plate 20. Thus, if a utensil is present, then the transmitted flux will reflect off the bottom of the utensil and a large portion of this reflected flux will be retransmitted through glass-ceramic plate 20 and detected by second detector element 44. If a utensil is not present, then the transmitted flux will not be reflected. Because of the high transmittance of glass-ceramic plate 20, the output of second detector element 44 will substantially greater when a utensil is present than when a utensil is not present. Thus, controller 30 can determine the presence or absence of a utensil by monitoring the output of second detector 44. As an alternative to using flux from heating unit 12, a secondary light source 48 (FIG. 1) such as an LED can be provided to selectively direct flux onto underside 21 of glass-ceramic plate 20.

The glass-ceramic temperature is measured by first detector element 42, which is arranged so as to be exposed to the flux exiting exit end 38 of waveguide 28. In response to this incident flux, optical detector 26 produces a voltage or output signal that is fed to controller 30, and controller 30 utilizes a transfer function that relates the output signal to a corresponding temperature of glass-ceramic plate 20. However, the total flux discharged from exit end 38 of waveguide 28 includes flux other than the flux radiated from glass-ceramic plate 20 (which is indicative of the glass-ceramic temperature). Additional flux includes flux that has been reflected from underside 21 of glass-ceramic plate 20, flux that has been reflected from other sources such as support pan 16 annular portion 18 or a utensil placed on glass-ceramic plate 20, and ambient background flux that has been transmitted through glass-ceramic plate 20. This additional flux, which is referred to herein as corruptive flux, is not indicative of the temperature of glass-ceramic plate 20 and thus results in measurement inaccuracies.

The present invention includes various approaches for reducing the impact of corruptive flux on the accuracy of the glass-ceramic temperature measurement. The desired error correction can be illustrated using a broad band filter as an example; in the ideal case the optical detector output is obtained as follows:

$$V_{opt}=\alpha_{opt}(T_g^4-\gamma_{rem}T_c^4)+\mathfrak{R}_{opt} \quad (1)$$

Here the error term is given by z,1 $_{o-e}$. In practice, there are several factors that affect the voltage output that would be obtained from optical detector 26. The impact of these factors as well as some of the electronics contribution are shown in equation (2) that summarizes the sensor output:

$$V_{sens}=\alpha_{o-e}(\bullet)(T_g^4-\gamma_{rem}(\bullet)T_c^4)+\mathfrak{R}_{o-e}(I,V,t)$$

In these equations, $T_g$ refers to the glass or target temperature, $T_c$ to the case temperature of the detector, and $\alpha_{opt}(\bullet)_1\ \gamma_{rem}(\bullet)$ refer to the general transfer function terms for the above case of a broad band filter, and $\alpha_{o-e}$, $\gamma_{o-e}$ refer to the combined effects of the electronics as well as the optical sensor. The notation ( ) is used to denote the fact that the functional dependence is not directly relevant here, and is not noted explicitly. Although the methods disclosed herein can address the general case, the case of $\gamma_{rem}=1$ can be referred to for brevity. Finally the error term $\mathfrak{R}_{o-e}$ of the transfer function depends, among other factors, on the current I through heating element 12, the voltage V across it, as well as the time t. For completeness, it should be noted that the general form of the $\alpha_{opt}$ can be approximated as follows:

$$\alpha_{opt,g} \approx \varepsilon_g \frac{\sigma}{\pi} \tau \frac{A_d A_g}{r_{d-g}^2} R_d \quad (3)$$

where $\sigma$ is the Stefan-Boltzman constant, $A_d$ & $A_g$ are the detector active area and target glass area respectively, and $\epsilon_g$ is the glass emissivity. Also, $\tau$ is the contribution for the optical path between glass-ceramic plate 20 and optical detector 26 including the transmission through the atmosphere, the reflections, and the effects due to waveguide 28, concentrators, etc. Finally $r_{d-g}$ is the effective distance or optical path length between the target and detector.

Figure 3:
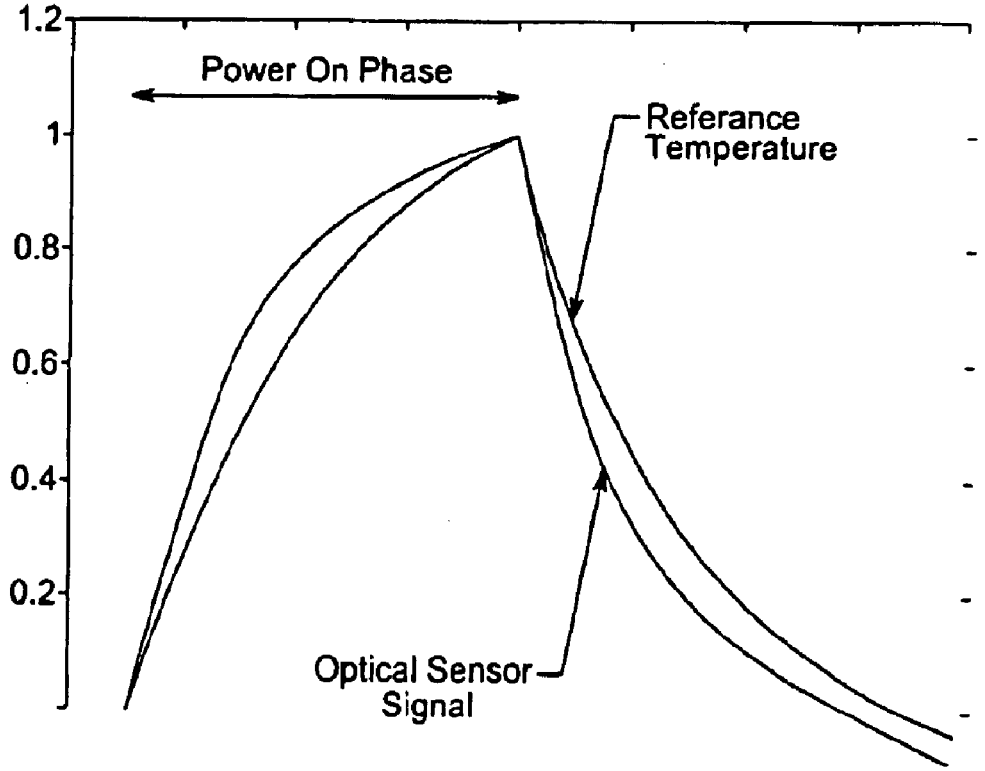
FIG. 3 is a plot of typical power on vs. power off phases of a burner assembly.

Referring to FIG. 3, one approach for obtaining the value of the error term above and modeling its dependence on various parameters comprises obtaining a fit for the power off phase by using Plank's law and the filter characteristics to define a fit for the output signal, $V_{opt_1}$ of optical detector 26 against a reference temperature. Then, this fit is applied for the power on phase and used to construct the expected signal for the power on phase, $E_{p_on}$. The error term $\mathfrak{R}_{o-e}$ is then obtained as follows:

$$\mathfrak{R}_{o-e}=V_{opt}-E_{p_on} \quad (4)$$

The next step is to obtain a map or a modeling of $\mathfrak{R}_{o-e}$ as a function of the current through heating element 12 or any of the other forms disclosed above. This provides a calibration of the error correction in terms of the current (or similarly the power or the voltage) through heating element 12. Conversely, the error correction can be calibrated in terms of $\mathfrak{R}_{o-e}/V_{opt}$ to model the error purely in terms of the output signal.

Figure 4:
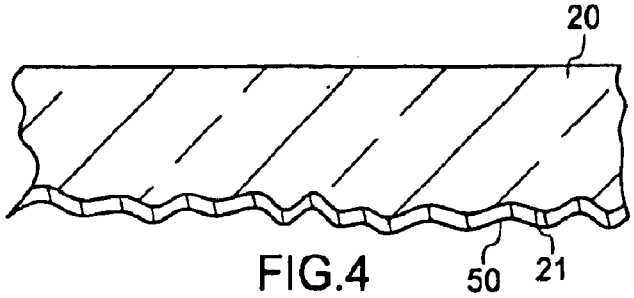
FIG. 4 is a sectional view of a portion of a glass-ceramic plate of the present invention.

A second approach for reducing the impact of corruptive flux on the accuracy of the glass-ceramic temperature measurement is to minimize the corruptive component of the flux incident on optical detector 26. One aspect of this approach is to lower the reflectivity of the underside 21 of glass-ceramic plate 20 by roughening it and/or providing it with a high temperature anti-reflection coating 50 as shown in FIG. 4. Suitable materials for anti-reflection coating 50 include $MgF_2$, SiO, $CeO_2$, and ZnS.

Figure 5:
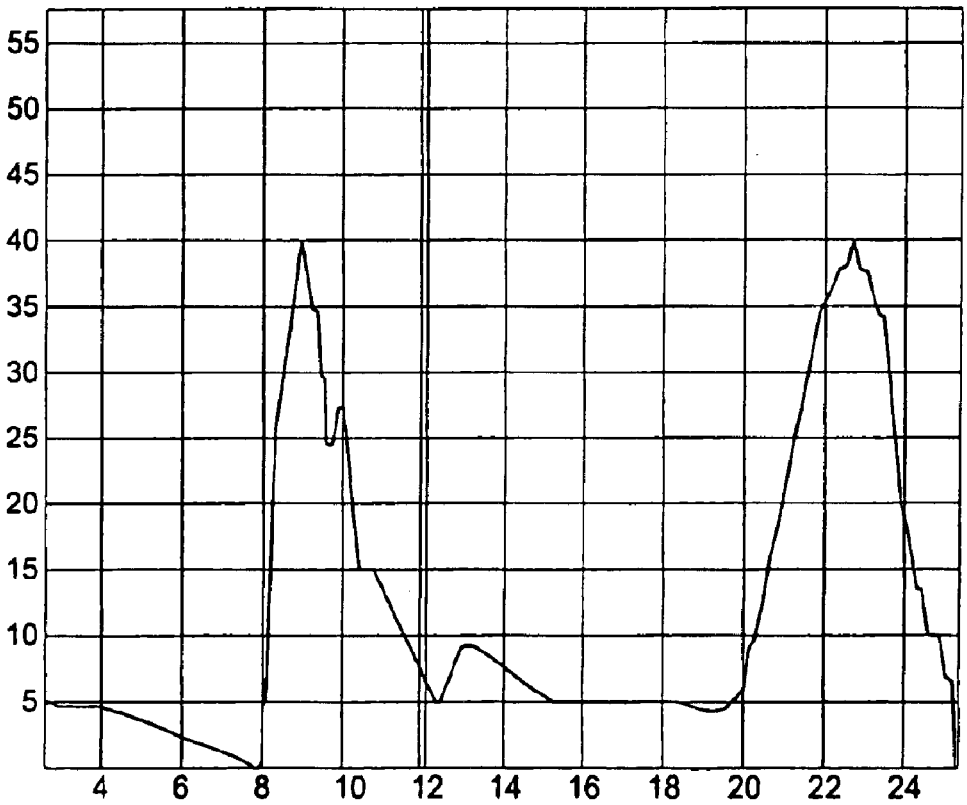
FIG. 5 is a plot of infrared specular reflectance as a function of wavelength for a commonly used glass-ceramic material.

A second aspect of the second approach is to use filter 40 to block flux in the spectrum in which reflected flux is most prevalent. Referring to FIG. 5, which plots the infrared specular reflectance (as a percentage of total incident flux) as a function of wavelength for a commonly used glass-ceramic material, it can be seen that reflection is most prevalent in the band from about 8 microns to about 12 microns and from the band from about 20 microns to about 25 microns. By designing filter 40 to block flux from these wavelength bands, the impingement of reflected flux onto optical detector 26 can be substantially eliminated. Filter 40 also can be designed to minimize other undesirable flux components such as transmission of ambient lighting and non-glass reflection.

A third approach is to compensate for corruptive flux that does impinge on optical detector 26 by using controller 30 to make an error correction to the output signal generated by optical detector 26. One scheme of compensating for corruptive flux includes monitoring the level of power or current or voltage supplied to heating unit 12 and correcting the output signal based on a scale factor corresponding to that level. In other words, there is a correlation between the amount of power or current or voltage that is input into heating unit 12 and the amount of flux that is reflected from underside 21 of glass-ceramic plate 20. As more power (or current or voltage) is provided to heating unit 12, more energy will be emitted from heating unit 12 and hence more flux will be reflected from glass-ceramic plate 20. Based on this correlation, scale factors for a range of power (or current or voltage) levels are determined empirically and stored in controller 30. Then, for any given level, controller 30 will call up the corresponding scale factor and apply it to the output signal generated by optical detector 26 to produce a corrected temperature measurement. The correction can be accomplished by subtracting the scale factor from the output signal or by using the scale factor in a ratio-based correction, depending on the type of scale factors used. The scale factors can also be calculated to account for corruptive flux due to background radiation and non-glass reflection.

Figure 6:
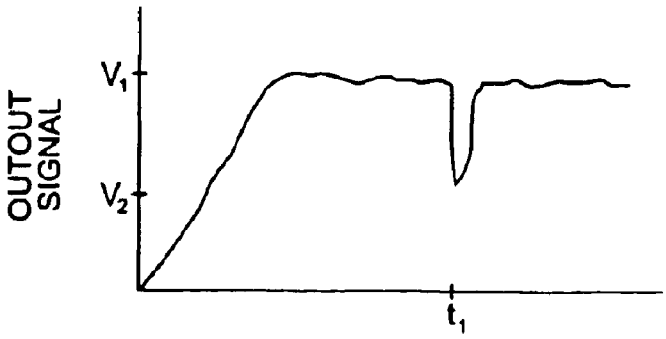
FIG. 6 is a plot an output signal from a detector element as a function of time to demonstrate how reflected flux is measured.

Another scheme of compensating for corruptive flux uses the optical detector's second detector element 44 to provide a direct measurement of reflectance, which is then used by controller 30 to correct the output signal generated by optical detector 26. As discussed above, controller 30 can detect the presence or absence of a utensil on the cooktop surface by monitoring the output of second detector element 44. Referring to FIG. 6, it is shown how the output of second detector element 44 can also be used to measure the amount of flux reflected from the underside 21 of glass-ceramic plate 20. FIG. 6 plots the output signal of second detector element 44, which is a voltage, against time. When heating unit 12 is activated, second detector element 44 will receive a total flux that has reflected and radiated components. After a certain amount of time, glass-ceramic plate 20 will reach a steady temperature, which will not change as long as the power to heating unit 12 and the load are constant.

As the glass-ceramic temperature reaches a relatively steady level, the output signal from second detector element 44 will attain a relatively steady first value V1 that is representative of the total flux impinging thereon. At some time t1 thereafter, the power to heating unit 12 will be turned off briefly. This will briefly remove the source of reflected flux such that the output signal from second detector element 44 will spike down to a second value V2. The second value V2 is representative of the non-reflective flux. By using only a brief shut off period, the effect on the temperature of glass-ceramic plate 20 and/or the utensil will be negligible. Taking the difference between the first and second values V1 and V2 will produce an error signal that is indicative of the reflective component of the total flux. Controller 30 will then subtract this error signal from the output signal generated by optical detector 26 to produce a corrected temperature measurement.

In another scheme of compensating for corruptive flux, controller 30 establishes and uses an estimate of the radiant energy or power of the corruptive flux to correct the output signal generated by optical detector 26. The estimated power of the corruptive flux, referred to herein as the optical power estimate, can be based on the relationship:

$$T_{clr}=a_1+a_2I \tag{5}$$

where $T_{clr}$ is the effective color temperature of heating element 12, $a_1$ and $a_2$ are constants determined by experimentation and calibration and I is the current through heating element 12. Thus, the effective color temperature is determined from equation (5) and the optical power estimate is obtained from the effective color temperature using a well known equation.

Alternatively, the optical power estimate can be established based on the relationship:

$$\frac{\Phi}{\Phi_0}=\left(\frac{V}{V_0}\right)^{\alpha} \tag{6}$$

for the flux $\Phi$, or $$\frac{P}{P_0}=\left(\frac{V}{V_0}\right)^{\beta} \tag{7}$$

for the power P. In equations (6) and (7), the values $\alpha$ and $\beta$ are experimentally determined exponents that are normally slightly greater than one, while $\Phi_0$, $V_0$ and $P_0$ represent nominal values for the flux, voltage and power, respectively. Therefore, $\Phi/\Phi_0$, $V/V_0$ and $P/P_0$ are dimensionless values representing the change from the nominal values. (While the voltage and nominal voltage are used as an example in equations (6) and (7), similar relationships to the current or power applied to heating element 12.) The optical power estimate is obtained from the flux derived from equation (6) or the power derived from equation (7) using well known relationships.

Once the optical power estimate is determined using one of equations (5), (6) or (7), controller 30 uses the optical power estimate to apply a ratio-based correction to the optical signal.

Another scheme of compensating for corruptive flux uses a percentage of the output signal generated by optical detector 26 to represent the contribution of the corruptive flux to the optical signal. Specifically, controller 30 corrects the optical signal by subtracting a predetermined percentage of the optical signal from the optical signal. The percentage can be based on an average value of the difference between the expected optical signal and the actual optical signal, which difference can be determined as the average difference between the output signal and the reference temperature as shown in FIG. 3. Generally, this percentage will be in the range of 5–15%.

In a relatively simple scheme of compensating for corruptive flux, controller 30 carries out a DC offset correction that includes the general DC reflection from glass-ceramic plate 20. In this case, controller 30 subtracts a DC offset correction from the output signal to correct the output signal. The DC offset represents, for example, the non-zero value of $a_1$ (from equation (5) above) when $a_2$ is zero.

It should be understood that the various approaches of correcting for corruptive flux, including minimizing the reflective component of the incident flux and compensating for the incident flux, are not mutually exclusive. Indeed, integration of some or all approaches (including one or more of the various schemes described therein) will optimize the accuracy of the glass-ceramic temperature measurement.

The foregoing has described various approaches for reducing the impact of reflected flux on the accuracy of the glass-ceramic temperature measurement. While specific embodiments of the present invention have been described it will be apparent to those skilled in the art that various modifications thereto can be made without departing from the spirit and scope of the invention as defined in the appended claims.

What is claimed is:

1. A sensor assembly for a glass-ceramic cooktop appliance having at least one burner assembly disposed under a glass-ceramic plate, said sensor assembly comprising:

an optical detector, said optical detector being arranged to receive radiation from said glass-ceramic plate and produce an output signal corresponding to a cooktop related property of said glass-ceramic plate; and a controller receiving said output signal from said optical detector, said controller including means for making a correction to said output signal for corruptive flux incident on said optical detector, wherein said means for making a correction monitors the power level, current level, or voltage level of said burner assembly and corrects said output signal based on a scale factor that corresponds to the power level, the current level, or the voltage level.

2. The sensor assembly of claim 1 wherein said cooktop related property is temperature.

3. The sensor assembly of claim 1 wherein said means for making a correction monitors the power level of said burner assembly and corrects said output signal based on a scale factor that corresponds to the power level .

4. The sensor assembly of claim 1 wherein said means for making a correction monitors the current level of said burner assembly and corrects said output signal based on a scale factor that corresponds to the current level.

5. The sensor assembly of claim 1 wherein said means for making a correction monitors the voltage level of said burner assembly and corrects said output signal based on a scale factor that corresponds to the voltage level.

6. The sensor assembly of claim 1 wherein said optical detector includes first and second detector elements, said first detector element producing said first-mentioned output signal and said second detector element producing a second output signal that is fed to said controller, said means for making a correction determining an error signal from said second output signal and subtracting said error signal from said first-mentioned output signal.

7. The sensor assembly of claim 1 wherein said means for making a correction subtracts a DC offset correction from said output signal.

8. The sensor assembly of claim 1 wherein said means for making a correction subtracts a predetermined percentage of said output signal from said output signal.

9. The sensor assembly of claim 8 wherein said predetermined percentage is in the range of about 5–15 percent.

10. The sensor assembly of claim 1 wherein said means for making a correction establishes and uses a power estimate of said corruptive flux to correct said output signal.

11. The sensor assembly of claim 10 wherein said power estimate is based on the relationship:

$$T_{clr}=a_1+aI_2$$

where Tclr is the effective color temperature of said burner assembly, a1 and a2 are constants, and I is the current through said burner assembly.

12. The sensor assembly of claim 10 wherein said power estimate is based on the relationship:

$$\frac{\Phi}{\Phi_0}=\left(\frac{V}{V_0}\right)^{\alpha}$$

where Φ is flux, Φ0 is a nominal flux value, V is voltage to said burner assembly, V0 is a nominal voltage value, and α is a constant.

13. The sensor assembly of claim 10 wherein said power estimate is based on the relationship:

$$\frac{P}{P_0}=\left(\frac{V}{V_0}\right)^{\beta}$$

where P is power, P0 is a nominal power value, V is voltage to said burner assembly, V0 is a nominal voltage value, and β is a constant.

14. The sensor assembly of claim 1 further comprising a filter disposed between said optical detector and said glass-ceramic plate, said filter blocking flux in the spectrum in which corruptive flux is most prevalent.

15. The sensor assembly of claim 1 wherein the underside of said glass-ceramic plate is roughened.

16. The sensor assembly of claim 1 wherein the underside of said glass-ceramic plate is provided with an anti-reflective coating.

17. A method for sensing cooktop related properties in a glass-ceramic cooktop appliance having at least one burner assembly disposed under a glass-ceramic plate and an optical detector arranged to receive radiation from said glass-ceramic plate and produce an output signal corresponding to a cooktop related property of said glass-ceramic plate, said method comprising:

monitoring said output signal; and making a correction to said output signal for corruptive flux incident on said optical detector, wherein said correction is made by monitoring the power level, current level or, voltage level of said burner assembly and correcting said output signal based on a scale factor that corresponds to the power level, the current level, or the voltage level.

18. The method of claim 17 wherein said correction is made by monitoring the power level of said burner assembly and correcting said output signal based on a scale factor that corresponds to the power level.

19. The method of claim 17 wherein said correction is made by monitoring the current level of said burner assembly and correcting said output signal based on a scale factor that corresponds to the current level.

20. The method of claim 17 wherein said correction is made by monitoring the voltage level of said burner assembly and correcting said output signal based on a scale factor that corresponds to the voltage level.

21. The method of claim 17 wherein said optical detector includes first and second detector elements, said first detector element producing said first-mentioned output signal and said second detector element producing a second output signal, and wherein said correction is made by determining an error signal from said second output signal and subtracting said error signal from said first-mentioned output signal.

22. The method of claim 17 wherein said correction is made by subtracting a DC offset correction from said output signal.

23. The method of claim 17 wherein said correction is made by subtracting a predetermined percentage of said output signal from said output signal.

24. The method of claim 23 wherein said predetermined percentage is in the range of about 5–15 percent.

25. The method of claim 17 wherein said correction is made by establishing and using a power estimate of said corruptive flux.

26. The method of claim 25 wherein said power estimate is based on the relationship:

$$T_{clr}=a_1+aI_2$$

where Tclr is the effective color temperature of said burner assembly, a1 and a2 are constants, and I is the current through said burner assembly.

27. The method of claim 25 wherein said power estimate is based on the relationship:

$$\frac{\Phi}{\Phi_0}=\left(\frac{V}{V_0}\right)^{\alpha}$$

where Φ is flux, $\Phi_0$ is a nominal flux value, V is voltage to said assembly, V0 is a nominal voltage value, and α is a constant.

28. The method of claim 25 wherein said power estimate is based on the relationship:

$$\frac{P}{P_0}=\left(\frac{V}{V_0}\right)^{\beta}$$

where P is power, P0 is a nominal power value, V is voltage to said burner assembly, V0 is a nominal voltage value, and β is a constant.

29. The method of claim 17 further comprising disposing a filter between said optical detector and said glass-ceramic plate, said filter blocking flux in the spectrum in which corruptive flux is most prevalent.

30. The method of claim 17 further comprising roughening the underside of said glass-ceramic plate.

31. The method of claim 17 further comprising providing an anti-reflective coating on the underside of said glass-ceramic plate.

32. A sensor assembly for a glass-ceramic cooktop appliance having at least one burner assembly disposed under a glass-ceramic plate, said sensor assembly comprising:

an optical detector, said optical detector being arranged to receive radiation from said glass-ceramic plate and produce an output signal corresponding to a cooktop related property of said glass-ceramic plate; and a controller receiving said output signal from said optical detector, said controller including means for making a correction to said output signal for corruptive flux incident on said optical detector, wherein said means for making a correction subtracts a DC offset correction from said output signal.

33. A sensor assembly for a glass-ceramic cooktop appliance having at least one burner assembly disposed under a glass-ceramic plate, said sensor assembly comprising:

an optical detector, said optical detector being arranged to receive radiation from said glass-ceramic plate and produce an output signal corresponding to a cooktop related property of said glass-ceramic plate; and a controller receiving said output signal from said optical detector, said controller including means for making a correction to said output signal for corruptive flux incident on said optical detector, wherein said means for making a correction subtracts a predetermined percentage of said output signal from said output signal.

34. The sensor assembly of claim 33 wherein said predetermined percentage is in the range of about 5–15 percent.

35. A method for sensing cooktop related properties in a glass-ceramic cooktop appliance having at least one burner assembly disposed under a glass-ceramic plate and an optical detector arranged to receive radiation from said glass-ceramic plate and produce an output signal corresponding to a cooktop related property of said glass-ceramic plate, said method comprising:

monitoring said output signal; and making a correction to said output signal for corruptive flux incident on said optical detector, wherein said correction is made by subtracting a DC offset correction from said output signal.

36. A method for sensing cooktop related properties in a glass-ceramic cooktop appliance having at least one burner assembly disposed under a glass-ceramic plate and an optical detector arranged to receive radiation from said glass-ceramic plate and produce an output signal corresponding to a cooktop related property of said glass-ceramic plate, said method comprising:

monitoring said output signal; and making a correction to said output signal for corruptive flux incident on said optical detector, wherein said correction is made by subtracting a predetermined percentage of said output signal from said output signal.

37. The method of claim 36, wherein said predetermined percentage is in the range of about 5–15 percent.

* * * * *